US009476638B1

(12) United States Patent
Tyler

(10) Patent No.: US 9,476,638 B1
(45) Date of Patent: Oct. 25, 2016

(54) COOLER WITH MULTIPLE COMPARTMENTS

(71) Applicant: Lanie J. Tyler, Lake City, FL (US)

(72) Inventor: Lanie J. Tyler, Lake City, FL (US)

( * ) Notice: Subject to any disclaimer, the term of this patent is extended or adjusted under 35 U.S.C. 154(b) by 217 days.

(21) Appl. No.: 14/141,884

(22) Filed: Dec. 27, 2013

Related U.S. Application Data

(60) Provisional application No. 61/831,286, filed on Jun. 5, 2013.

(51) Int. Cl.
*B65D 88/74* (2006.01)
*F25D 31/00* (2006.01)

(52) U.S. Cl.
CPC ..... *F25D 31/005* (2013.01)

(58) Field of Classification Search
CPC ..... F25D 31/00; F25D 31/005; F25D 31/006
USPC ..... 220/592.01, 592.02, 592.09, 592.16, 220/592.2, 592.03, 592.08, 592.22, 592.23, 220/565; 206/372, 373, 499, 558, 541; 99/357, 484, 376; 62/331, 457.7, 440, 62/457.1, 459, 451, 457.9, 464; 126/25 R, 126/41 R, 40, 50, 37 R; 190/18 R, 18 A, 115; 280/655.1, 655, 47.26
See application file for complete search history.

(56) References Cited

U.S. PATENT DOCUMENTS 3,866,994 A * 2/1975 Bonin ..... 312/236
4,468,932 A 9/1984 Bullard
6,153,857 A 11/2000 Gunnels
6,176,499 B1 * 1/2001 Conrado et al. ..... 280/47.26
6,315,149 B1 11/2001 Conrado et al.
6,739,150 B2 * 5/2004 Mompo Garcia ..... 62/457.7
6,763,678 B2 7/2004 Harper
6,895,778 B1 5/2005 Ackerman
7,143,601 B1 12/2006 Jimenez
7,284,393 B1 * 10/2007 Macmillan ..... 62/457.7
7,909,148 B1 3/2011 Miller et al.
2004/0226313 A1 * 11/2004 Busick ..... 62/397
2006/0000365 A1 * 1/2006 Attie ..... 99/340
2006/0065665 A1 3/2006 Swartfager et al.

* cited by examiner

*Primary Examiner* — Steven A. Reynolds
*Assistant Examiner* — Javier A Pagan
(74) *Attorney, Agent, or Firm* — Robert C. Montgomery; Montgomery Patent & Design LP

(57) ABSTRACT

A cooler assembly with multiple compartments comprised of a bottom floor, two parallel longitudinal sidewalls, a grill end, a handle end and two lateral interior dividing walls is disclosed. The dividing walls separate the interior into a grill end compartment, a storage end compartment, and a cooler compartment. Each compartment has its own hinged top panel, with the center cooler compartment designed for cold food storage. The cooler assembly also includes a water filtration system for recycling and reuse of melt water from the cooler. A slide out grill assembly is disposed within the grill end and a fold out tabletop is disposed upon the top of the cooler compartment. The cooler is wheeled to allow transport to a desired location and umbrella mounts are included on the cooler body.

17 Claims, 12 Drawing Sheets

COOLER WITH MULTIPLE COMPARTMENTS

RELATED APPLICATIONS

The present invention was first described in and claims the benefit of U.S. Provisional Application No. 61/831,286, filed Jun. 5, 2013, the entire disclosures of which are incorporated herein by reference.

FIELD OF THE INVENTION

The present invention relates generally to a cooler having multiple compartments, a water filtration system, and a drain disposed thereon for draining accumulated fluid from within an interior cavity.

BACKGROUND OF THE INVENTION

Spending time in the great outdoors is among the most popular fair weather leisure time activities. Whether it is fishing, camping, at a picnic, having a cookout, or just a simple party, a great deal of time is spent preparing and consuming food and drink. A piece of equipment commonly found at these activities is the rolling picnic cooler. While the rolling picnic cooler is very good at keeping large amounts of food cold, it does not provide a ready means to carry other items associated with the picnic, such as plates, cups, eating utensils, condiments, or even the cooking grill itself. These items typically must be carried separately by the user in another container, or separately altogether by another person, or even in another trip. Accordingly, there exists a need for a means by which a common rolling picnic cooler can be adapted to carry, store, and organize items other than cold food associated with a picnic, without the disadvantages as described above.

SUMMARY OF THE INVENTION

The disadvantages of the prior art are overcome by the present invention in providing a cooler assembly with multiple compartments comprised of a bottom floor, two (2) parallel longitudinal sidewalls, a grill end, a handle end and two (2) lateral interior dividing walls. The dividing walls separate the interior into a grill end compartment, a storage end compartment, and a cooler compartment. Each compartment has its own hinged top panel, with the center cooler compartment designed for cold food storage. The cooler assembly also includes a water filtration system for recycling and reuse of melt water from the cooler. A slide-out grill assembly is disposed within the grill end and a fold-out tabletop is disposed upon the top of the cooler compartment. The cooler is wheeled to allow transport to a desired location and umbrella mounts are included on the cooler body. The use of the present invention provides a means for transporting all types of food and supplies associated with outdoor eating, in a manner which is quick, easy, and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
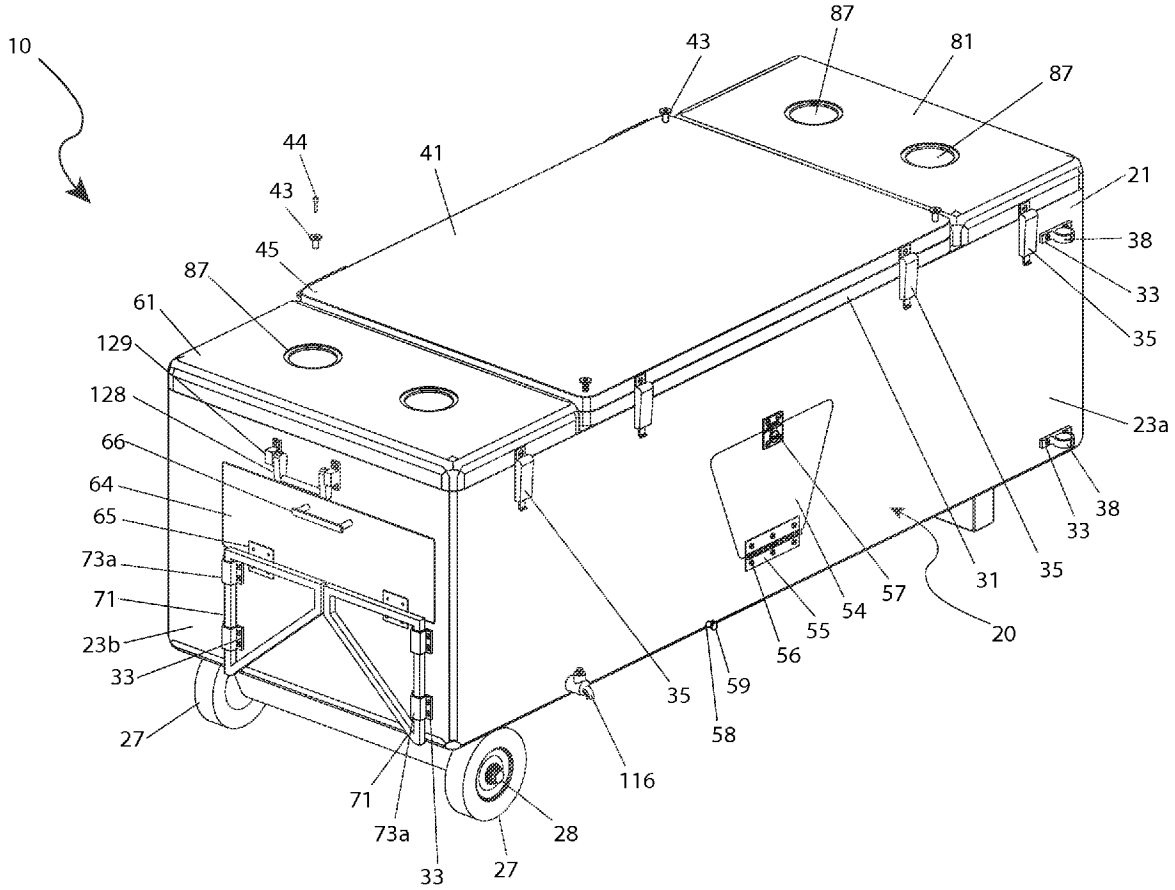
FIG. 1 is a perspective view of a cooler with multiple compartments 10 in accordance with the preferred embodiment of the present invention.

10 cooler with multiple compartments
20 omnibus assembly
21 shell
22 interior
23*a* sidewall
23*b* end

24 bottom
25 axle support
26 axle
27 wheel
28 hub
29 stand
30 cooler compartment
31 cooler compartment lid
32 cooler compartment lid hinge
33 fastener
35 latch assembly
36 latch strike
38 umbrella bracket
41 tabletop
42 tabletop hinge
43 button
44 button fastener
45 button receiver
46 table support
47 table support trunnion
48*a* first table support bracket half
48*b* second table support bracket half
51 cooler insert
52 slide tray
54 access door
55 access door hinge
57 access door latch
58 drain
59 drain plug
60 grill compartment
61 grill compartment lid
62 first dividing wall
63 grill aperture
64 grill aperture cover
65 grill aperture cover hinge
66 grill aperture cover handle
67 gas grill
68 grill slide
71 grill support
72 grill support trunnion
73*a* first grill support bracket half
73*b* second grill support bracket half
75 grill backsplash
76 gas bottle
77 gas valve
78 gas supply hose
79 spare gas bottle
80 storage compartment
81 storage compartment lid
82 storage compartment lid hinge
85 second dividing wall
87 cup holder
90 extendable handle assembly
91 handle housing
92 extendable handle
93 extendable handle stop
95 handle slide way
96 handle aperture
97 handle aperture seal
98 slide way plug
100 water filtration system
101 permeate pump
102 water level switch
103 battery pack
106 filter header
107 first stage filter
108 second stage filter
109 thin film composite membrane
112 water tubing
114 storage tank
115 pressure valve/regulator
116 spigot
118 drain
125 cooler light
126 cooler light switch
128 side handle
129 handle pivot
131 cargo net
132 cargo net aperture

DETAILED DESCRIPTION OF THE PREFERRED EMBODIMENT

The best mode for carrying out the invention is presented in terms of its preferred embodiment, herein depicted within FIGS. 1 through 15. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The present invention describes a cooler with multiple compartments (herein referred to as the "device") 10, which provides a means to transport a plurality of items to suit a user's taste, plus chilled food and/or beverages, and ice from one location to another. Reference in this embodiment to the front of the device 10 will indicated the sidewall 23 opposite of the cooler compartment lid hinges 32. The right side of the device 10 will correspond to the user's right side while standing in front of and facing the device 10.

Figure 2:
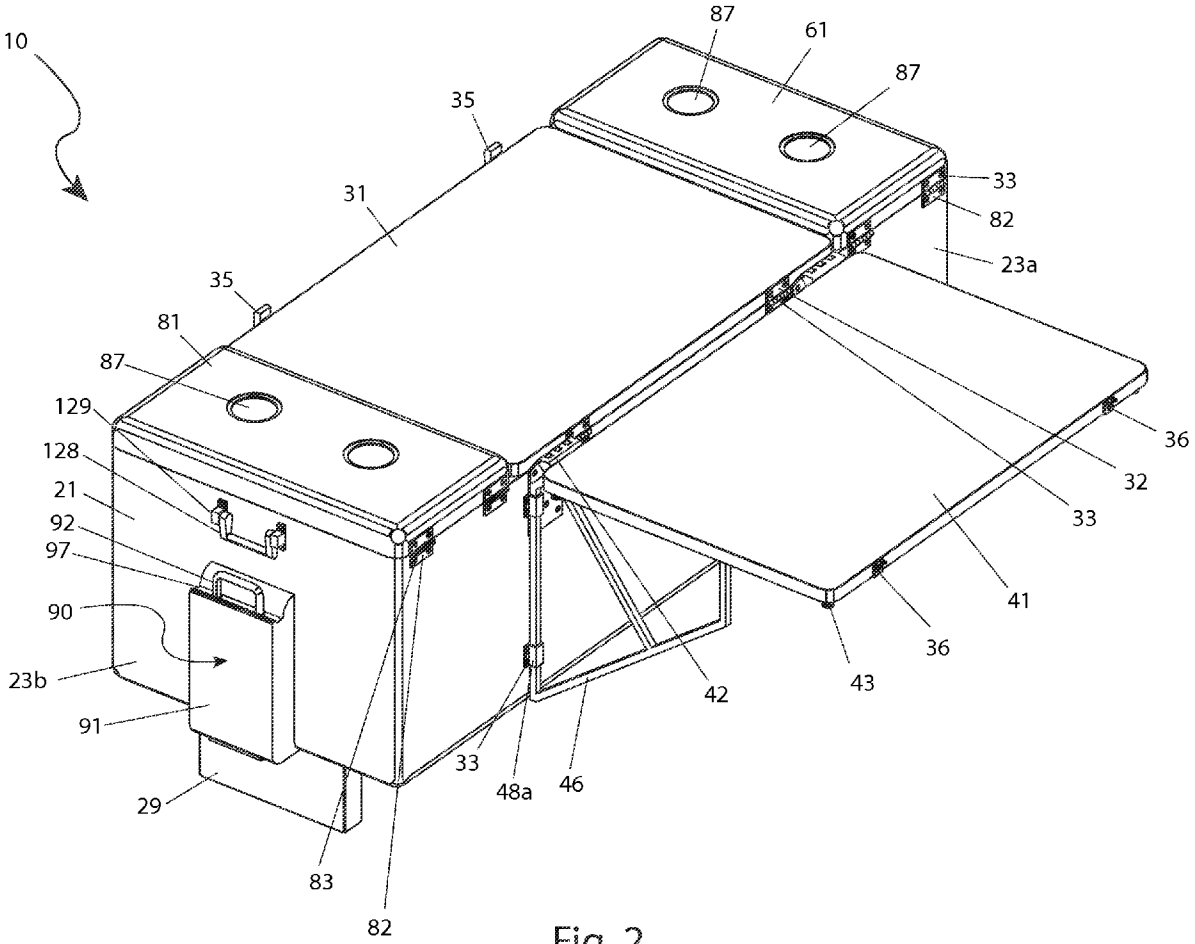
FIG. 2 is a perspective view with the table supports 46 deployed and a table top 41 open for the cooler with multiple compartments 10 in accordance with the preferred embodiment of the present invention.
Figure 4:
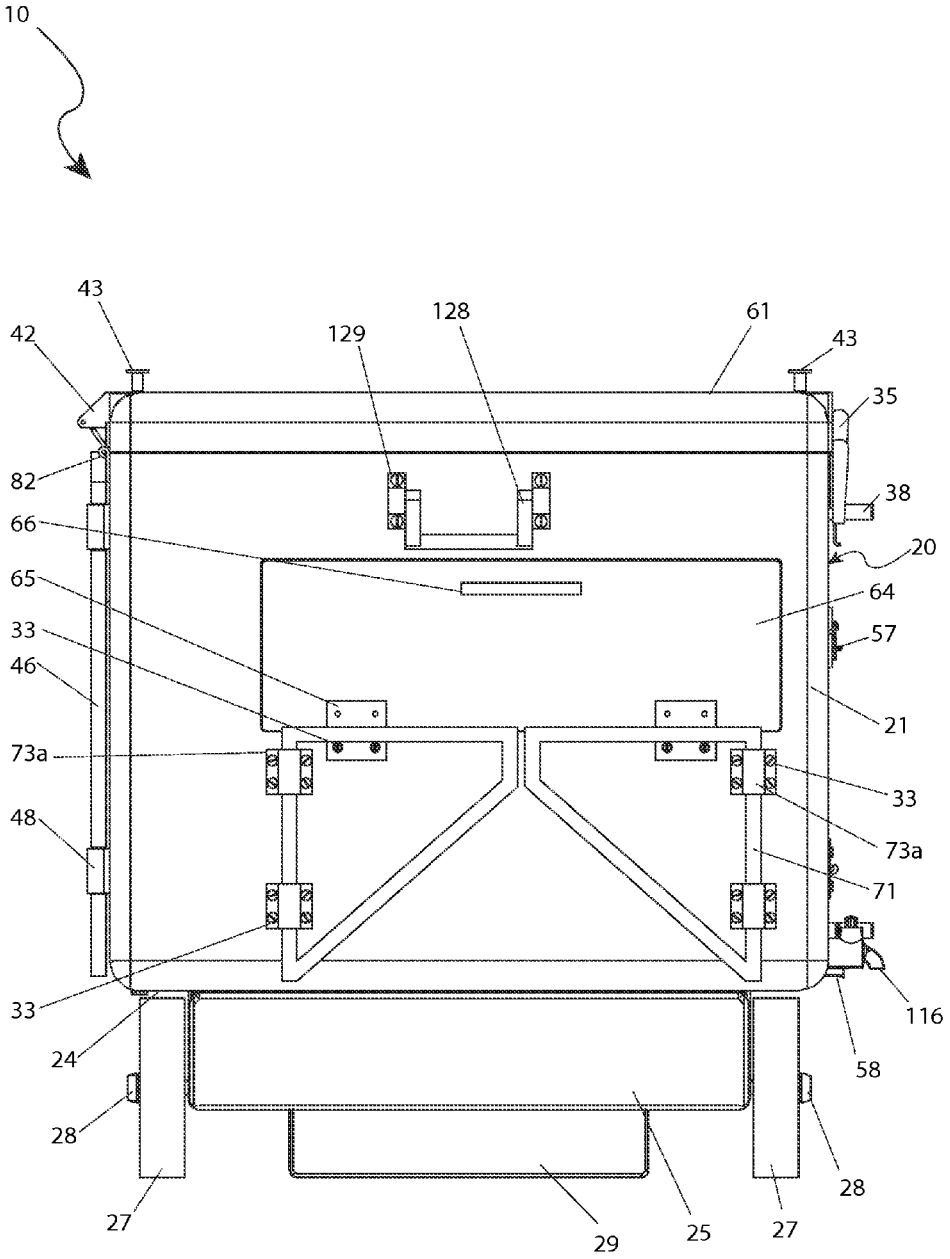
FIG. 4 is a left side elevation view of the cooler with multiple compartments 10 in accordance to the preferred embodiment of the present invention.
Figure 5:
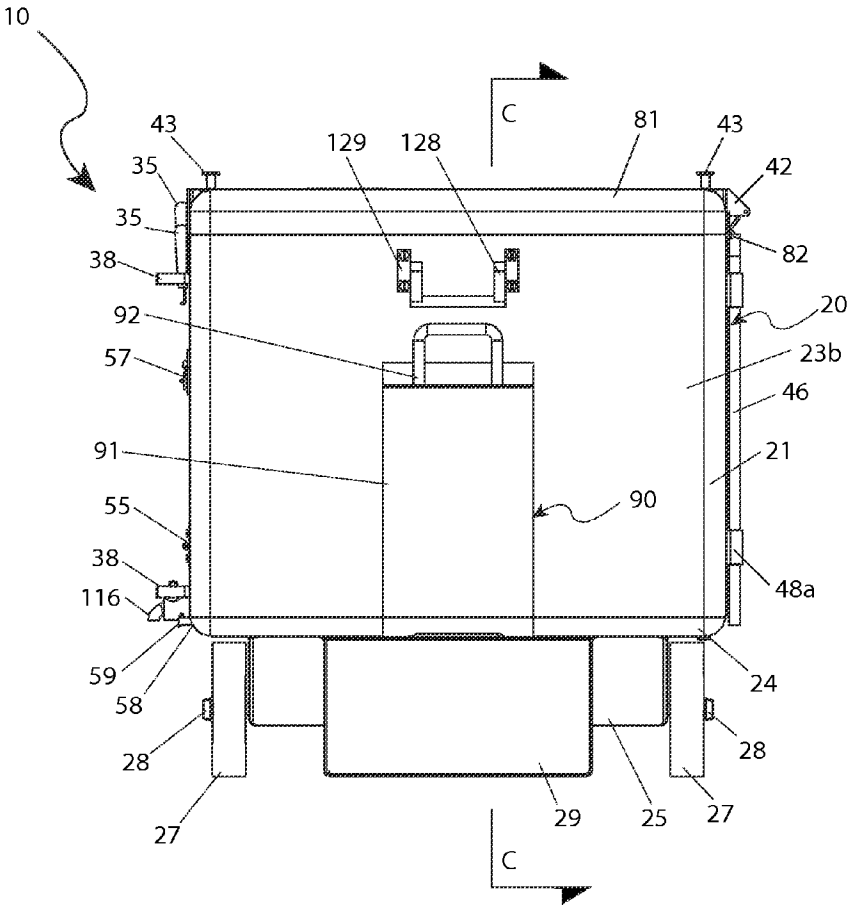
FIG. 5 is a right side elevation view of the cooler with multiple compartments 10 in accordance to the preferred embodiment of the present invention.
Figure 7:
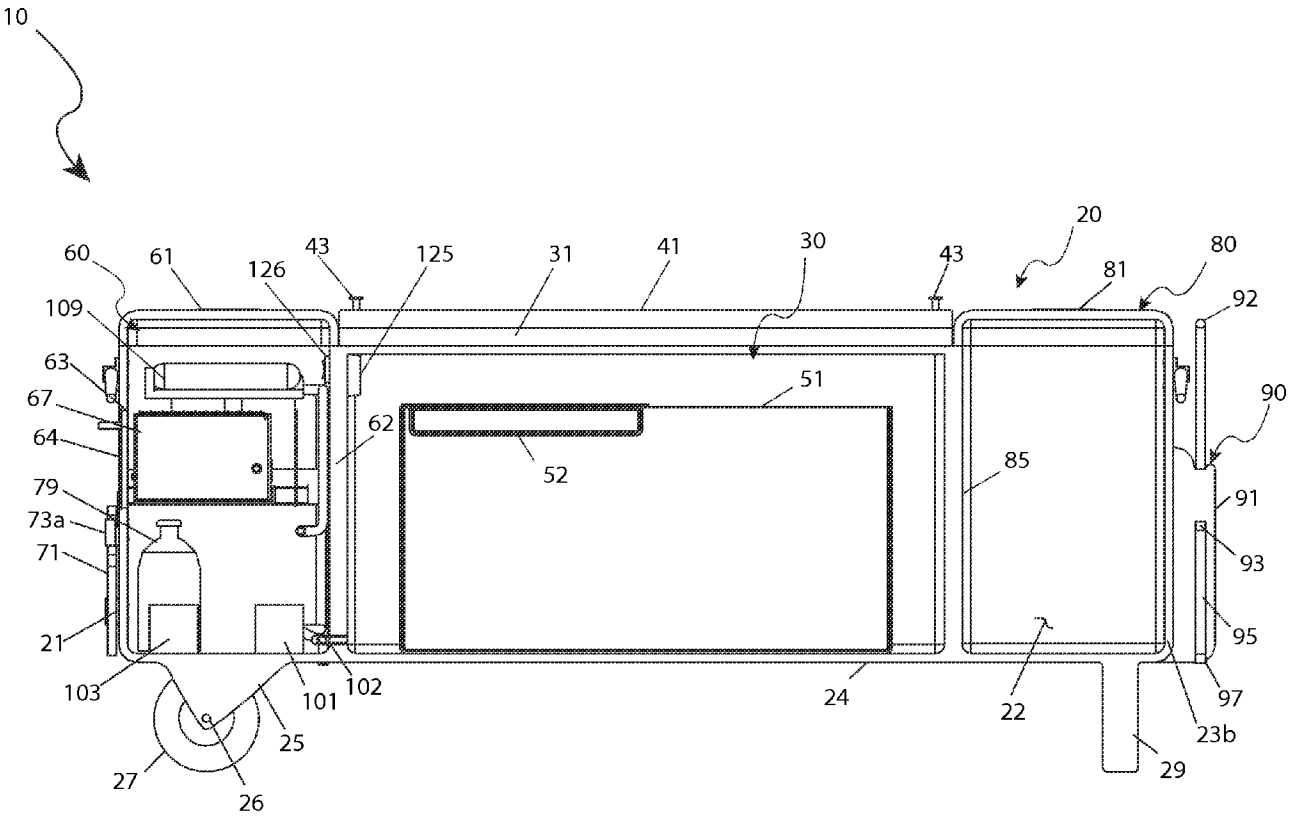
FIG. 7 is a section view along line A-A as shown on FIG. 3 cut through the cooler with multiple compartments 10 in accordance to the preferred embodiment of the present invention.

Referring now to FIGS. 1 and 2, perspective views, as well as FIGS. 4 and 5, side elevation views of the device 10, according to the preferred embodiment of the present invention, are disclosed. The device 10 includes an omnibus assembly 20 comprised of an exterior shell 21, which includes a bottom floor 24, two (2) opposing parallel longitudinal sidewalls 23*a*, and two (2) opposing lateral parallel ends 23*b*, which define the hollow interior 22. The bottom floor 24 and sidewalls 23 are made of a formed thermoplastic material with thermally insulating properties. The sidewalls 23*a* and ends 23*b* are preferably further provided with an infrared reflective coating to reduce the effects of radiant heat on the interior 22 of the device 10.

Disposed on the exterior of the bottom floor 24, preferably located near the left side, is an axle support 25. This axle support 25 is a protrusion of a portion of the width of the bottom floor 24 of the exterior shell 21, comprised of the same material, and intended to hold an axle 26 at a fixed distance from said bottom floor 24 and provide structural support for the device 10. The central axis of the axle 26 will be held perpendicular to the longitudinal axis of the device 10 by the axle support 25. A pair of wheels 27 approximately six inches (6 in.) in diameter preferably comprised of a nylon material is attached to either end of the axle 26 and retained thereon preferably with an interference spring tab hub 28, for transporting the device 10 without entirely lifting it. A side handle 128 is attached to supportive pivots 129 on each of the opposing ends 23*b* for lifting or carrying the device 10. A stand 29 is disposed along at least a portion of a right side edge of the bottom floor 24 for maintaining the device 10 at a generally level orientation when it is not being transported.

The omnibus assembly 20 is provided with a cooler compartment lid 31, a grill compartment lid 61, and a storage compartment lid 81. These lids 31, 61, and 81 are preferably comprised of a formed thermoplastic material with thermally insulating properties and coated with an infrared reflective material in keeping with the sidewalls 23*a* and ends 23*b*. The cooler compartment lid 31 is pivotally attached to one of the sidewalls 23*a* by at least two (2) cooler compartment lid hinges 32. These lid hinges 32 are attached first to the shell 21 and then to the cooler compartment lid 31 with a plurality of threaded fasteners 33 which are preferably comprised of an aluminum alloy or another metal with a plating to inhibit corrosion. The grill compartment lid 61 and the storage compartment lid 81 are pivotally attached to one of the sidewalls 23*a* by at least two (2) storage compartment lid hinges 82. The storage compartment lid hinges 82 are attached first to the shell 21 and then to the respective compartment lids 61, 81 with a plurality of fasteners 33. As shown throughout the FIGURES, the hinging of the lids 31, 61, and 81 are illustrated on same side of the assembly 20; however, it should be appreciated that the present invention is not limited in this arrangement. The grill compartment lid 61 and the storage compartment lid 81 are provided with a plurality of cup holders 87 which are comprised of a depression in the lids 61, 81. The cooler compartment 30 includes a drain 58 formed into the shell 21 and which can be plugged with an integrally attached drain plug 59. The drain 58 provides an operable means to dispose any unwanted liquid from the cooler compartment 30 to the outside of the device 10.

Figure 13:
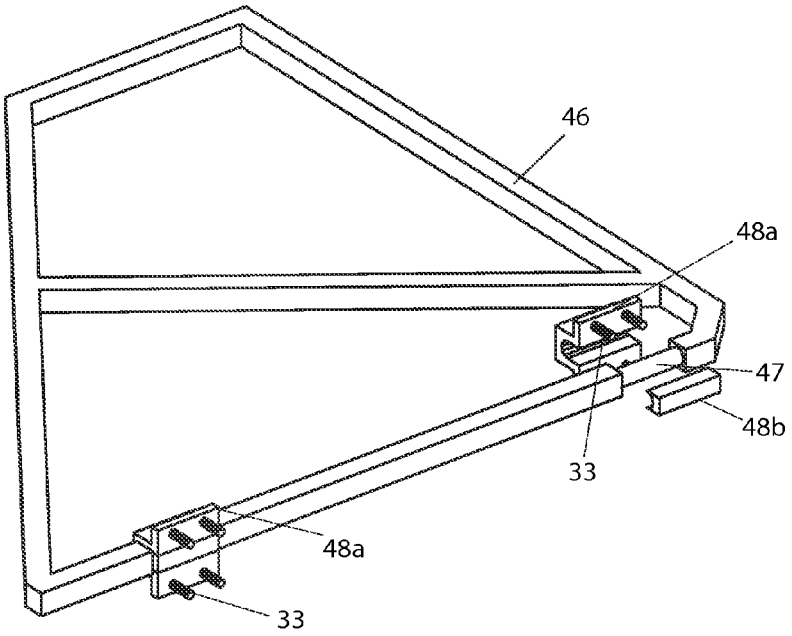
FIG. 13 is a perspective view of a table support 46 showing a detail of the table support bracket 48 pivotally attached to a table support trunnion 47 of the cooler with multiple compartments 10 in accordance with the preferred embodiment of the present invention.

A tabletop 41, preferably comprised of a formed thermoplastic material with an anti-microbial coating, is pivotally attached to the shell 21 by two (2) table hinges 42. These table hinges 42 are attached first to the shell 21 and then to the edge of the tabletop 41 with a plurality of threaded table hinge fasteners (not shown). The tabletop 41 is located superjacent to the cooler compartment lid 31 in a closed position, and pivots one hundred eighty degrees (180°) to a position adjacent to the omnibus assembly 20 and supported upon a pair of table supports 46. The table supports 46 are formed in one (1) piece as an injection molded thermoplastic part, or aluminum, or other metal with a coating to inhibit corrosion. The table supports 46 are preferably formed with an integral table support trunnion 47 as seen in FIG. 13 to be pivotally retained in a plurality of table support bracket halves 48*a*, 48*b* attached to the sidewall 23*a* with a plurality of fasteners 33. The table support bracket halves 48*a*, 48*b* are comprised of a two-part assembly comprised of a first table support bracket half 48*a* having an elongated concave surface that bears against approximately one half (½) of the table support trunnion 47, and a second table support bracket half 48*b* which fits into that elongated slot of said first table support bracket half 48*a* while being provided with an appropriate concave surface to bear against, and capture, the remainder of said table support trunnion 47. The table support bracket halves 48*a*, 48*b* are retained by fasteners 33. The table supports 46 are turned parallel to the longitudinal axis of the device 10 for storage and transportation of the device 10, and then pivoted to a perpendicular orientation to deploy the tabletop 41 as seen in FIG. 2.

A pair of over-center, spring-biased, latch assemblies 35 are deployed along the upper portion of the sidewall 23*a* opposite the hinges 42 that engage the corresponding latch strikes 36 located on the tabletop 41 to secure the cooler compartment lid 31 and the tabletop 41 in a closed position. The latch assemblies 35 could be comprised of any other suitable latching mechanism, such as hasp-type latches, toggle latches, cam latches, or the like without violating the form of this embodiment. When the tabletop 41 is closed the latch assemblies 35 are able to engage the latch strikes 36 to hold the tabletop 41 and the cooler compartment lid 31 closed and maintain the thermally depressed state of the device 10.

Figure 15:
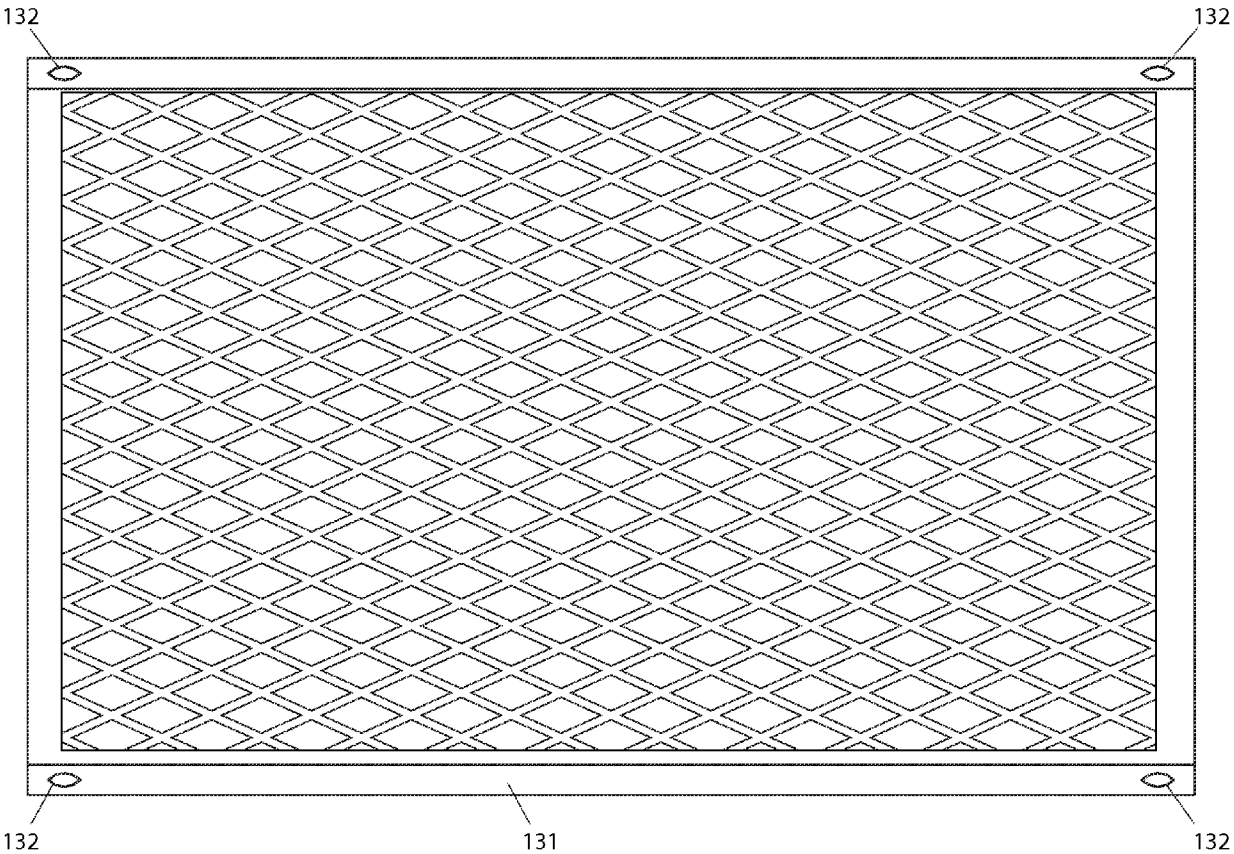

Disposed upon that surface of the tabletop 41 which faces upward in the closed and latched position is a plurality of buttons 43, located preferably near the corners of the tabletop 41, and secured with a threaded button fastener 44 into a threaded button receiver 45 in said tabletop 41. The buttons 43 are comprised preferably of a thermoplastic material with horizontal base having an aperture for the insertion of the button fastener 44 and a hollow cylindrical vertical stem terminating in a horizontal annular disk. It is understood that other materials, such as drawn or cast metals, could be used in the fabrication of the buttons 43 without narrowing the scope of the invention. The purpose of the buttons 43 is to retain an elasticized cargo net 131, as seen in FIG. 15, which could be used to tenuously hold miscellaneous items on top of the device 10 for coincidental transportation, or temporary storage. The cargo net 131 is comprised of a plurality of interwoven, or latticed, cords having a nylon thread outer covering with a rubberized core material and any number of woven nylon edge bindings provided with a plurality of cargo net apertures 132 to be slipped over the buttons 43.

Figure 12:
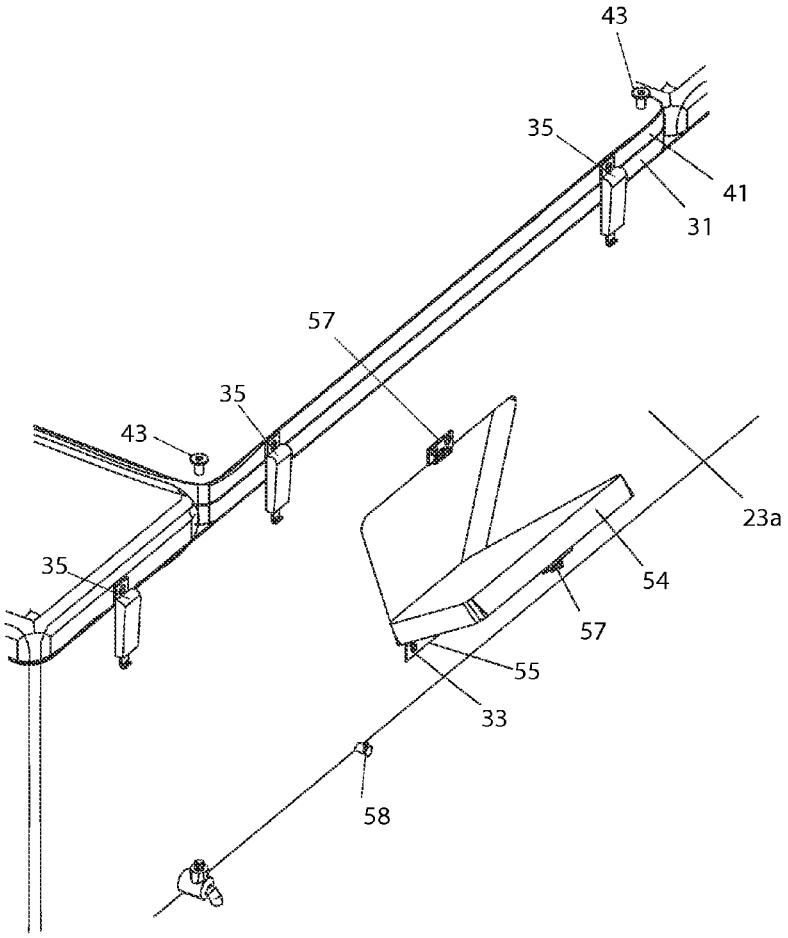
FIG. 12 is a close-up perspective view of the access door 54 for ice retrieval opened for use of the cooler with multiple compartments 10 in accordance with the preferred embodiment of the present invention.

Disposed upon one (1) of the sidewalls 23*a*, generally in a central location and opposite the table support 46, is an access door 54 which provides another entry into the cooler compartment 30, as seen in FIG. 12, for the purpose of retrieving items stored therein. The access door 54 is pivotally attached to the sidewall 23*a* by means of an access door hinge 55, which is preferably comprised of a non-reactive metal, or a metal with a plating to inhibit corrosion. The access door hinge 55 may also be comprised of a thermoplastic material without limiting the scope of the invention. The access door hinge 55 is secured to the access door 54 and the front sidewall 23 by means of a plurality of fasteners 33. The access door 54 is normally held in the closed position by an access door latch 57. The access door latch 57 is preferably a cam-type latch, but may be a hasp-type latch, a toggle latch or the like. Disposed upon one of the sidewalls 23*a*, opposite the grill end, is a pair of umbrella brackets 38 which are attached by means of a plurality of fasteners 33. The umbrella holder brackets are in vertical alignment. It is known that the umbrella holder brackets 38 can be alternately positioned at other locations on the shell 21 of the device 10.

Figure 3:
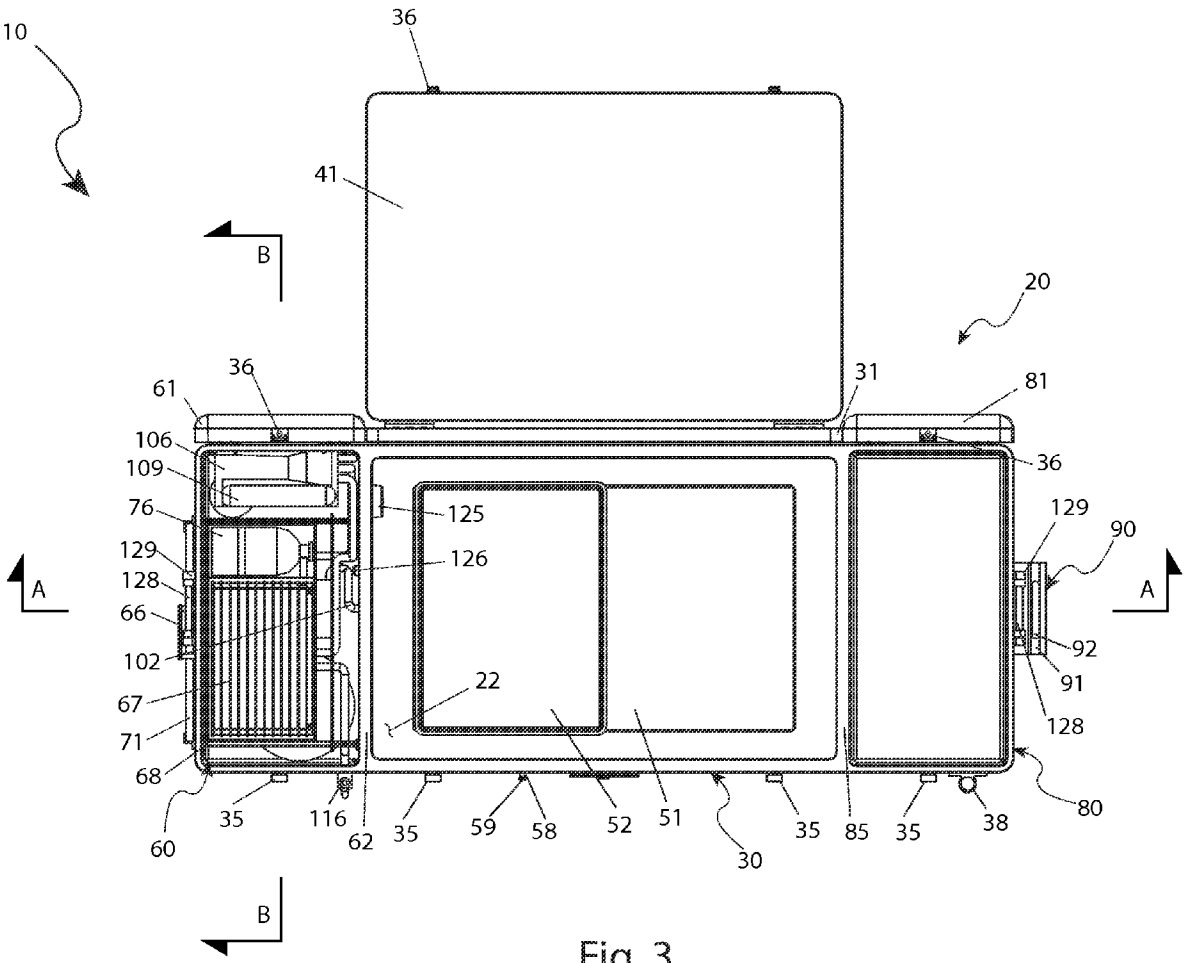
FIG. 3 is a plan view of the cooler with multiple compartments 10 depicted with the lids 31, 61, and 81 in an open position revealing an interior 22 with a plurality of sections in accordance to the preferred embodiment of the present invention.

Referring now to FIG. 3, a plan view of the device 10 with the tabletop 41, the cooler compartment lid 31, the grill compartment lid 61 and the storage compartment lid 81 in an open disposition according to the preferred embodiment of the present invention, is disclosed. The hollow interior 22 is divided into a plurality of compartments, a cooler compartment 30, a grill compartment 60 and a storage compartment 80. The cooler compartment 30 and the grill compartment 60 are separated by a first dividing wall 62, while the cooler compartment 30 and the storage compartment 80 are separated by a second dividing wall 85. The dividing walls 62 and 85 are preferably formed into the cooler shell 21 at the point of original fabrication.

Disposed in the interior 22 of the cooler compartment 30 is a cooler insert 51 comprised of a thermally conductive metal such as aluminum. The cooler insert 51 is rectangular and somewhat smaller in size than the interior of the cooler compartment 30 so that foodstuffs or beverages may be inserted. The space between the exterior of the cooler insert 51 and the interior of the cooler compartment 30 can preferably be filled with ice pieces up to a level corresponding to the height of said cooler insert 51. Additionally, a slide tray 52, having exterior dimensions somewhat smaller than the interior dimensions of the cooler insert 51, and equipped with an overextending upper flange, can be fit into said cooler insert 51 to keep certain items separate from other items in the cooler compartment 30.

Disposed upon an upper part of the first dividing wall 62, inside of the cooler compartment 30, is a cooler light 125. The cooler light 125 is preferably a small diameter, puck-style light employing a plurality of LED light sources, or other type of lighting, to illuminate the interior of the cooler compartment 30. The cooler light 125 is powered by the preferably rechargeable battery pack 103 located in the grill compartment 60 and operated by the cooler light switch 126 disposed on the upper part of the first dividing wall 62 in the grill compartment 60.

Figure 6:
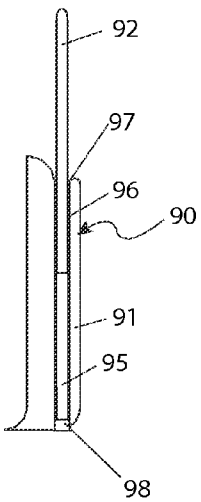
FIG. 6 is a section view along line C-C as shown on FIG. 5 cut through the extendable handle assembly 90 of the cooler with multiple compartments 10 in accordance to the preferred embodiment of the present invention.

Referring now to FIG. 6, a section view along the line C-C, as seen on FIG. 5, according to the preferred embodiment of the present invention, is disclosed. The device 10 includes an extendable handle assembly 90 comprised of a handle housing 91 with a handle slide way 95. An extendable handle assembly 90 is attached to the end 23*b* opposite the grill end for providing the impetus for motion as well as controlling the direction and speed of travel of the device 10. The handle housing 91 can be integrally molded with the shell 21 during fabrication of the device 10. The extendable handle 92 retracts downwardly within the handle housing 91 when not in use, as seen in FIG. 2, and extends upwardly into the deployed position when in use. The extendable handle 92 includes a pair of vertical supports and a horizontal grip connected between upper ends of the vertical supports. The vertical supports move along the interior vertical handle slide way 95 formed into the handle housing 91. An extendable handle stop 93 is placed horizontally on the ends of the vertical supports of the extendable handle 92 to limit the upward travel of the extendable handle 92. The geometry of the handle slide way 95 in the handle housing 91 would be sufficient to accommodate the handle stop 93 for the majority of the upward travel, but then terminate to limit the travel and keep the extendable handle 92 from becoming dislodged from the handle housing 91. That distance between the terminus of the handle slide way 95 and the top of the handle housing 91 would be provided with two (2) handle apertures 96 to accommodate the vertical supports of the extendable handle 92. The top of the handle apertures 96 are preferably provided with handle aperture seals 97 which would seal around the vertical supports of the extendable handle 92 to exclude debris and moisture from entering the handle slide way 95. The handle aperture seals 97 will provide a sufficient interference fit around the vertical supports of the extendable handle 92 to retain said extendable handle 92 in the up position while also allowing it to easily be pushed downward when not in use. A slide way plug 98 is inserted into the lower open end of the handle slide way 95 after the extendable handle stop 93 is installed on the extendable handle 92 at the time of manufacturing to keep out debris or other foreign matter. It is understood that the device 10 may be configured without the extendable handle assembly 90, if desired, thereby limiting the mode of transportation of the device 10.

Figure 8:
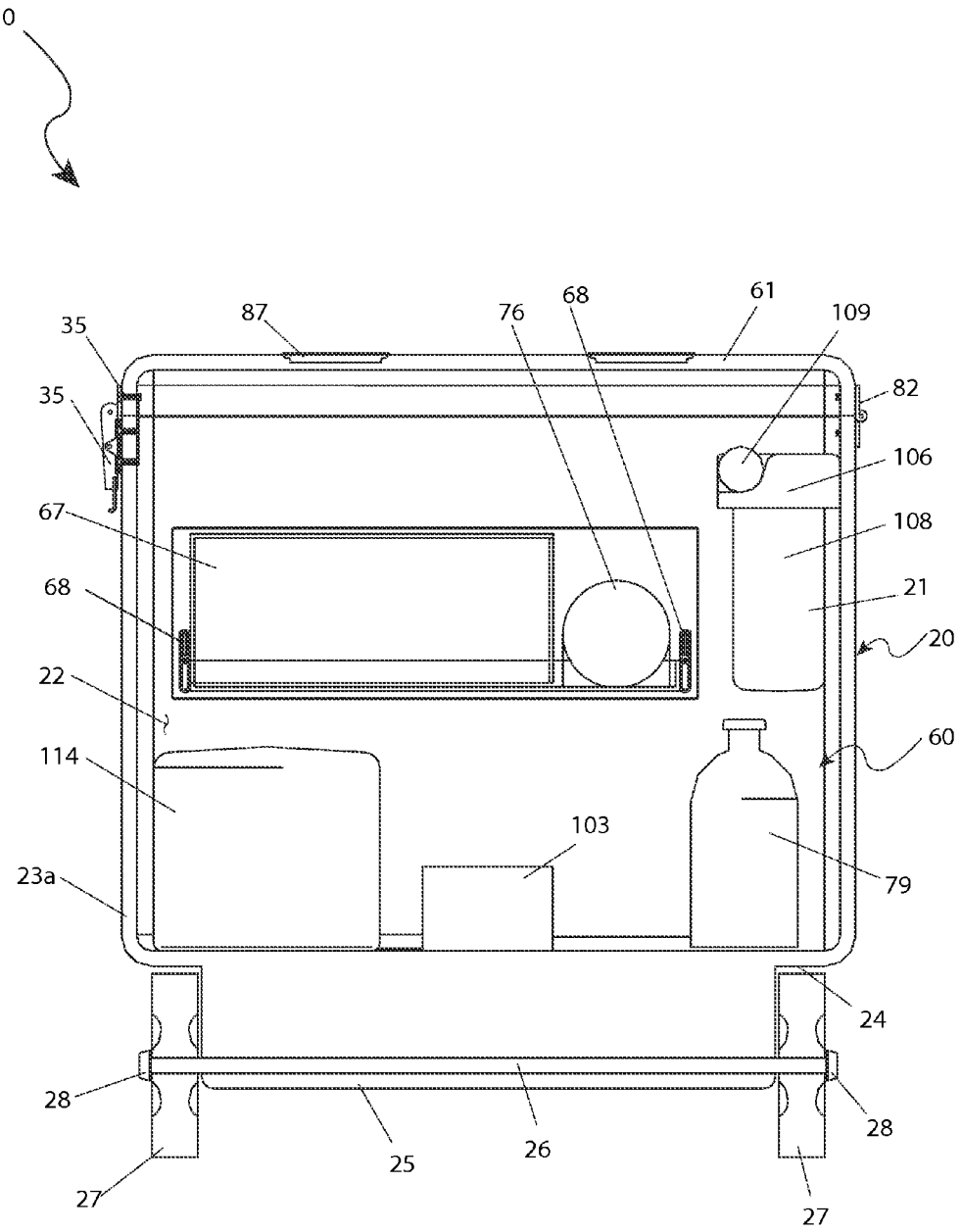
FIG. 8 is a section view along line B-B as shown on FIG. 3 cut through the grill compartment 60 of the cooler with multiple compartments 10 in accordance with the preferred embodiment of the present invention.
Figure 10:
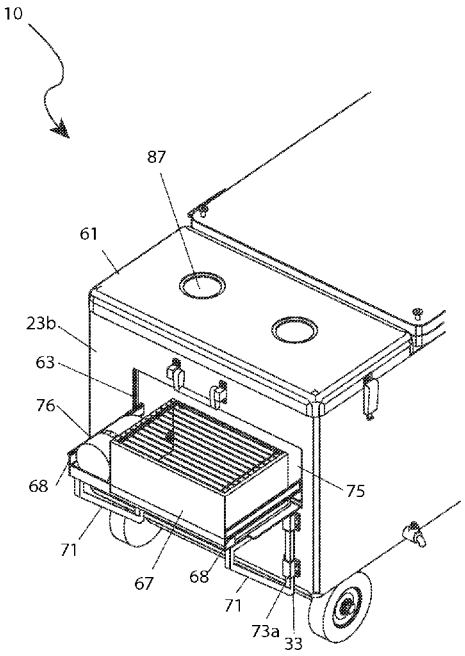
FIG. 10 is a perspective view of the gas grill 67 in an open for-use position of the cooler with multiple compartments 10 in accordance with the preferred embodiment of the present invention.
Figure 11:
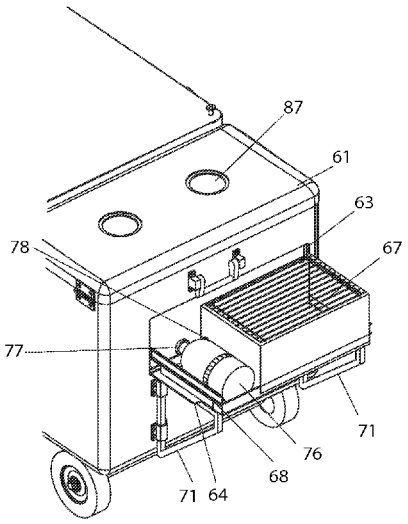
FIG. 11 is a perspective view from another angle of the gas grill 67 in an open for-use position of the cooler with multiple compartments 10 in accordance with the preferred embodiment of the present invention.
Figure 14:
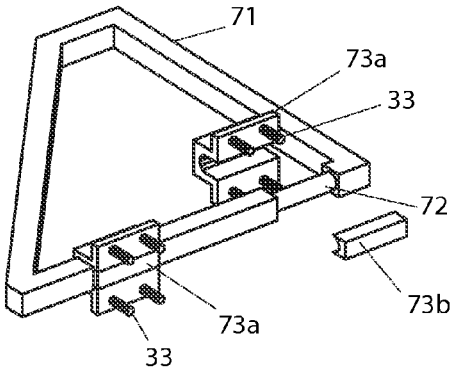
FIG. 14 is a perspective view of a grill support 71 showing a detail of the grill support bracket 73 pivotally attached to a grill support trunnion 72 of the cooler with multiple compartments 10 in accordance with the preferred embodiment of the present invention; and, FIG. 15 is a plan view of a cargo net 131 of the cooler with multiple compartments 10 in accordance with the preferred embodiment of the present invention.

Referring now to FIG. 8, a section view along line B-B as seen in FIG. 3 of the grill compartment 60, as well as FIGS. 10 and 11, perspective views of the gas grill 67 of the device 10, according to the preferred embodiment of the present invention, is disclosed. Disposed upon the end 23*b* of the shell 21 are two (2) grill supports 71. The grill supports 71 are turned perpendicular to the longitudinal axis of the device 10 for storage and transportation of the device 10, and then pivoted to a parallel orientation to deploy the gas grill as seen in FIGS. 10 and 11. The grill supports 71 are formed in one (1) piece as an injection molded thermoplastic part, or aluminum, or other metal with a coating to inhibit corrosion. The grill supports 71 are preferably formed with an integral grill support trunnion 72 as seen in FIG. 14 to be pivotally retained in a plurality of grill support bracket halves 73*a*, 73*b* attached to the end 23*b* with a plurality of fasteners 33. The grill support bracket halves 73*a*, 73*b* are similar in construction and function to the previously detailed table support bracket halves 48*a*, 48*b*.

A grill aperture 63 is formed into the end 23*b* of the assembly 10 that extends into the grill compartment 60 during the initial fabrication of the shell 21. The gas grill 67 is housed in the grill compartment 60 through the grill aperture 63 and is drawn out, at least partially, of the grill aperture 63 for use. A grill aperture cover 64 closes off the grill aperture 63 when the gas grill 67 is stowed. The grill aperture cover 64 is pivotally attached to the end 23*b* by means of a pair of grill aperture cover hinges 65. The grill aperture cover hinges 65 are attached to the grill aperture cover 64 and fastened to the end 23*b* by means of a plurality of fasteners 33. The grill aperture cover hinges 65 could incorporate the use of a spring to assure the full closure of the grill aperture cover 64, or a separate latch mechanism could alternately be used for that purpose. A grill aperture cover handle 66 is disposed on the outer surface of the grill aperture cover 64.

The gas grill 67 is suspended in the grill compartment 60 on a pair of grill slides 68. The grill slides 68 preferably use roller wheels and formed slide rails as a means of providing the necessary support and mobility to the gas grill 67; however, other types of roller mechanisms could be used. The grill slides 68 could additionally be provided with positional detents or other mechanical interferences to limit the travel of the gas grill 67, or the gas grill 67 can be removed completely from the compartment 60. Incorporated in the grill slide 68 mechanism is a grill back splash 75 comprised preferably of a metal plate which would fit against the inner side of the end 23*b* when the gas grill 67 is in use to prevent spatter from said gas grill 67 from entering the grill compartment 60. Attached to the gas grill 67, preferably by means of an over-center latch mechanism, is a user-supplied gas bottle 76 equipped with a gas valve 77 and containing the necessary fuel to be used in said gas grill 67. The gas valve 77 would be connected in a conventional manner to a gas supply hose 78 attached to the burner of the gas grill 67. The gas grill 67 would be of a conventional style, having a pivotally attached grill and a burner that would make use of a variety of petroleum by-products for fuel. The gas grill could further be equipped with a piezo igniter, as well as apertures for the introduction of an open flame for ignition. There would be sufficient space within the grill compartment 60 for the storage of at least one (1) user-supplied spare gas bottle 79.

Figure 9:
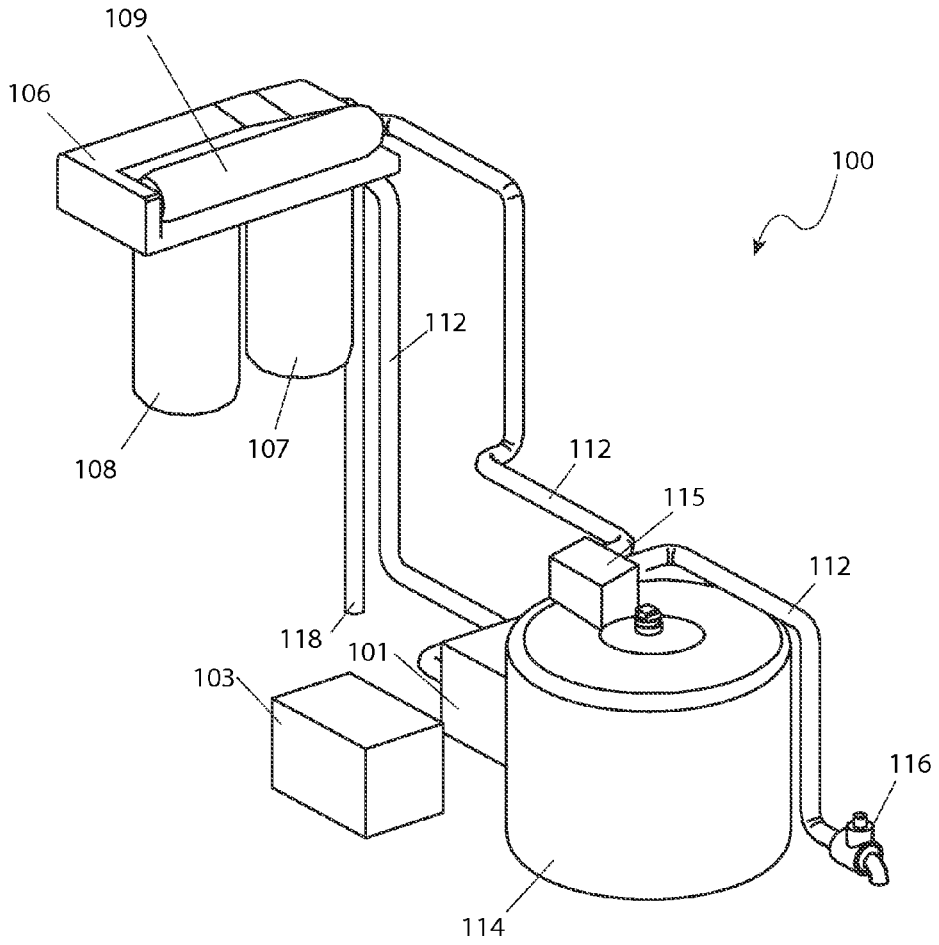
FIG. 9 is an isolated view of a water filtration system 100 of the cooler with multiple compartments 10 in accordance with the preferred embodiment of the present invention.

Referring now to FIG. 9, an isolated view of the water filtration system 100 of the device 10, according to the preferred embodiment of the present invention, is disclosed. The water filtration system 100 is a typical reverse osmosis filtration system used to remove dirt and food particulates, as well as chlorine and other chemicals. The thin film composite membrane 109 will remove total dissolved solids, metals, viruses, and bacteria. The water filtration system 100 is comprised of a permeate pump 101, a water level switch 102, the filters 107 and 108, the thin film composite membrane 109, a storage tank 114, and the interconnecting water tubing 112. The permeate pump 101 is driven by a battery-operated electric motor, and collects the water from the melted ice and any condensate at the bottom of the cooler compartment 30 and pumps the water through the system, as well as providing the force to overcome the osmotic pressure across the thin film composite membrane 109. The permeate pump 101 can be equipped with an on/off switch for additional control of the system, however the presence of water will normally be a sufficient system control. The water level switch 102 will shut off the permeate pump 101 when the water level in the cooler section 30 is too low to safely operate the water filtration system 110. The first stage filter 107 removes any sediment and particulates. The second stage filter 108 removes chlorine and other chemicals such as fruit juices. The thin film composite membrane 109 removes matter at the ionic level such as dissolved solids and bacteria. After passing through the thin film composite membrane 109 the water is potable and is stored in the storage tank 114 which is equipped with a pressure valve/regulator 115 to shut off the water filtration system 100 when the storage tank 114 is full. The potable water can be drained from the storage tank 114 through the spigot 116 located on the forward end 23*b* of the device 10. The pressure regulation portion of the pressure valve/regulator 115 lowers the pressure of the water supplied to the spigot 116 from the pressure of the water resident in the storage tank 114 if necessary. For every one gallon (1 gal.) of potable water delivered by the water filtration system 100 approximately another four gallons (4 gal.) of water are cycled through the water filtration system 100 and sent to a drain 118 in the bottom floor 24 of the grill compartment 60.

The preferred embodiment of the present invention can be utilized by the common user in a simple manner with little or no training by performing a series of steps. It can be appreciated that the operational steps can be performed in alternative order and as such any operational description of use should not be viewed as a limiting factor. The first step would, of course, be acquiring a model of the device 10 having the desired style to suit the user's taste.

The multiple-compartment configuration of the interior 22 allows the device 10 to perform multiple storage tasks. The cooler compartment 30 can be used to store various foodstuffs in a cold environment by placing ice or an ice/water mixture within the cooler compartment 30 on the exterior of the cooler insert 51. The thermally conductive walls of the cooler insert 51 would allow for the transfer of heat from said cooler insert 51 to the ice to cool the foodstuffs held within. Other items not requiring cooling can be placed into the storage compartment 80. Items can be retained on the exterior of the device 10 by placing such items upon the closed and latched tabletop 41 and placing the cargo net 131 over the items and securing the apertures 132 of the said cargo net 131 to the buttons 43 attached to said tabletop 41.

The tabletop 41 can be used as a work surface adjacent to the device 10 by performing the following steps: removing any items which may be retained on top of the device 10; pivoting the table supports 46 to a position perpendicular to the longitudinal axis of the device 10: unlatching the tabletop 41; pivoting the tabletop 41 about the table hinges 42 approximately one hundred eighty degrees (180°) and placing said tabletop 41, button 43 side down, onto the deployed table supports 46.

The gas grill can be used for the preparation of certain foods by performing the following steps: pivoting the grill supports 71 to a position parallel to the longitudinal axis of the device 10; pivoting the grill aperture cover 64 to the grill supports 71; sliding the gas grill 67 on the grill slides 68 to the position that the grill back splash 75 contacts the interior surface of the end 23*b* of the grill compartment 60; opening the gas valve 77 on the gas bottle 79; igniting the gas at the burner, and making any final adjustments of the gas valve 77 to achieve the heat output to accomplish the cooking process.

The water filtration system 100 is an automatic system that should only require monitoring, and occasionally replacing, the filters 107, 108, and 109 and providing sufficiently charged battery packs 103. When the water level switch 102 senses a sufficient amount of water present in the cooler compartment 30, the water filtration system 100 will turn on to circulate the water through the filtration stages and eventually pump the, now potable, water into the storage tank 114. When the pressure in the storage tank 114 reaches a preset maximum, as measured by the pressure valve/regulator 115, the water filtration system will turn off. The water filtration system 100 will also be shut off by the water level switch 102 when the water level in the cooler compartment 30 falls too low. When the water pressure in the storage tank 114 drops to a preset minimum, as measured by the pressure valve/regulator 115, the water filtration system 100 will be turned on. An on/off switch may be provided for the eventuality of replacing any of the filters 107, 108, or 109 while the water filtration system 100 could possibly turn on. The umbrella brackets 38 can be utilized by inserting the support pole of a user-supplied umbrella into the apertures for stability.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cooler, comprising:

an exterior shell defining a rectangular box shaped interior wherein said shell comprises a bottom floor, two parallel longitudinal sidewalls, a grill end, a handle end, and two lateral dividing walls; wherein said two lateral dividing walls are disposed within said interior to separate said interior into a grill end compartment, a storage end compartment, and a cooler compartment for storing ice;

a grill compartment lid hingedly disposed over said grill end compartment;

a storage compartment lid hingedly disposed over said storage end compartment;

a cooler compartment lid hingedly disposed over said cooler compartment;

a wheel assembly affixed to said bottom floor proximate to said grill end;

a stand affixed to said bottom floor opposite said wheel assembly proximate to said storage end compartment;

a grill assembly slidably attached within said grill compartment, and, a water filtration system having a permeate pump that pumps collects melted ice water from the bottom of said cooler compartment, said permeate pump further for forcing collected melted ice water though at least one filter into a reservoir;

wherein said grill assembly is housed within said grill compartment when in a stored position and is extendable outward from said grill end for use.

2. The cooler of claim 1, further comprises:

a grill support shelf hingedly attached to said grill end;

wherein said grill support shelf secures and retains said grill assembly in said grill compartment when said grill assembly is stowed and said grill support is in an upright closed position; and, wherein said grill support shelf provides horizontal support to said grill assembly when said grill assembly is deployed and said grill support is in an open position.

3. The cooler of claim 2, further comprises:

at least one grill support pivotally attached to said grill end below said grill assembly; wherein said at least one grill support is operable to extend outward from said grill end to support said grill support shelf and said grill assembly when said grill assembly is deployed for use.

4. The cooler of claim 1, further comprises:

a fuel source disposed within said grill compartment and operative to supply fuel to said grill assembly;

wherein said fuel source is in fluid communication with said grill assembly.

5. The cooler of claim 1, wherein said water filtration system is disposed within said grill compartment and is adapted to supply potable water.

6. The cooler of claim 5, wherein said water filtration system is a reverse osmosis filtration system.

7. The cooler of claim 1, further comprising a drain located within said shell in fluid communication with said cooler compartment.

8. The cooler of claim 1, further comprising a tabletop hingedly affixed to said shell immediately above said cooler compartment lid;

wherein said tabletop is hinged oppositely from said cooler compartment lid;

wherein said tabletop lays flush upon said cooler compartment lid when in a closed position and extends outwardly open from said sidewall to provide a table surface when in an open position; and, wherein when in said open position, said tabletop provides access to said cooler compartment lid.

9. The cooler of claim 8, further comprising at least one table support pivotally attached to said sidewall below said hinged attachment of said tabletop;

wherein said at least one table support is operable to extend outward from said sidewall to support said tabletop when said tabletop is in said open position.

10. The cooler of claim 9, further comprising an access door hingedly attached to one of said sidewalls opposite said at least one table support for providing access into said cooler compartment.

11. The cooler of claim 1, further comprising an extendable handle assembly comprises:

a handle housing affixed to said handle end of said cooler and an extendable handle disposed within said handle housing;

wherein said extendable handle is operable to extend from and retract into said handle housing.

12. A cooler, comprising:

an exterior shell defining an interior comprising a bottom floor, two parallel longitudinal sidewalls, a grill end, a handle end, and two lateral dividing walls; wherein said two lateral dividing walls are disposed within said interior to separate said interior into a grill end compartment, a storage end compartment, and a cooler compartment for storing ice;

a grill compartment lid hingedly disposed over said grill end compartment;

a storage compartment lid hingedly disposed over said storage end compartment;

a cooler compartment lid hingedly disposed over said cooler compartment;

a wheel assembly affixed to said bottom floor proximate to said grill end;

a stand affixed to said bottom floor opposite said wheel assembly proximate to said handle end;

an extendable handle assembly affixed to said handle end;

a grill assembly slidably attached within said grill compartment;

a fuel source disposed within said grill compartment and operative to supply fuel to said grill assembly; and, a water filtration system having a permeate pump that pumps collects melted ice water from the bottom of said cooler compartment, said permeate pump further for forcing collected melted ice water though at least one filter into a reservoir;

wherein said grill assembly is housed within said grill compartment when in a stored position and is extendable outward from said grill end for use.

13. The cooler of claim 12, further comprises;

a grill support shelf hingedly attached to said grill end;

wherein said grill support shelf secures and retains said grill assembly in said grill compartment when said grill assembly is stowed and said grill support is in an upright closed position; and, wherein said grill support shelf provides horizontal support to said grill assembly when said grill assembly is deployed and said grill support is in an open position.

14. The cooler of claim 13, further comprises:

at least one grill support pivotally attached to said grill end below said grill assembly;

wherein said at least one grill support is operable to extend outward from said grill end to support said grill support shelf and said grill assembly when said grill assembly is deployed for use.

15. The cooler of claim 12, further comprising a tabletop hingedly affixed to said shell immediately above said cooler compartment lid;

wherein said tabletop is hinged oppositely from said cooler compartment lid;

wherein said tabletop lays flush upon said cooler compartment lid when in a closed position and extends outwardly open from said sidewall to provide a table surface when in an open position; and, wherein when in said open position, said tabletop provides access to said cooler compartment lid.

16. The cooler of claim 15, further comprising at least one table support pivotally attached to said sidewall below said hinged attachment of said tabletop;

wherein said at least one table support is operable to extend outward from said sidewall to support said tabletop when said tabletop is in said open position.

17. A cooler, comprising:

an exterior shell defining an interior comprising a bottom floor, two parallel longitudinal sidewalls, a grill end, a handle end and two lateral dividing walls; wherein said two lateral dividing walls are disposed within said interior to separate said interior into a grill end compartment, a storage end compartment, and a cooler compartment for storing ice;

a grill compartment lid hingedly disposed over said grill end compartment;

a storage compartment lid hingedly disposed over said storage end compartment;

a cooler compartment lid hingedly disposed over said cooler compartment;

a tabletop hingedly affixed to said shell immediately above said cooler compartment lid;

at least one table support pivotally attached to said sidewall;

a wheel assembly attached to said shell so as to come in contact with a ground surface;

a stand affixed to said bottom floor opposite said wheel assembly proximate to said handle end;

an extendable handle assembly affixed to said handle end;

a grill assembly slidably attached within said grill compartment;

at least one grill support pivotally attached to said grill end below said grill assembly;

a fuel source disposed within said grill compartment and operative to supply fuel to said grill assembly; and, a water filtration system for filtering melted ice water from said cooler compartment;

a water filtration system having a permeate pump that pumps collects melted ice water from the bottom of said cooler compartment, said permeate pump further for forcing collected melted ice water though at least one filter into a reservoir;

wherein said grill assembly is housed within said grill compartment when in a stored position and is extendable outward from said grill end for use.

* * * * *